US009599351B2

(12) United States Patent
Bruin-Slot

(10) Patent No.: US 9,599,351 B2
(45) Date of Patent: Mar. 21, 2017

(54) MODULAR VENT HOOD BLOWER KIT FOR IN-LINE OR EXTERNAL APPLICATION

(71) Applicant: Whirlpool Corporation, Benton Harbor, MI (US)

(72) Inventor: Zachary J. Bruin-Slot, Baroda, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 620 days.

(21) Appl. No.: 14/061,779

(22) Filed: Oct. 24, 2013

(65) Prior Publication Data

US 2015/0114384 A1 Apr. 30, 2015

(51) Int. Cl.

| | |
|---|---|
| ***F24C 15/20*** | (2006.01) |
| *F24F 3/16* | (2006.01) |
| *B08B 15/00* | (2006.01) |
| *F24F 11/00* | (2006.01) |

(52) U.S. Cl.

CPC ..... *F24C 15/2042* (2013.01); *F24C 15/20* (2013.01); *F24C 15/2071* (2013.01); *B08B 15/002* (2013.01); *F24F 3/1607* (2013.01); *F24F 11/0001* (2013.01)

(58) Field of Classification Search

CPC .. F24C 15/2042; F24C 15/2071; F24C 15/20; F24C 15/2078; F24C 15/2085; F24F 3/1607; F24F 11/0001; B08B 15/002; B08B 15/023; F08B 2215/003

USPC ..... 126/299 D, 293, 299 F; 454/56–67

IPC ..... F24C 15/20; F24F 3/16; B08B 15/02

See application file for complete search history.

(56) References Cited

U.S. PATENT DOCUMENTS

| | | | | | |
|---|---|---|---|---|---|
| 2,081,640 | A | * | 5/1937 | Petersen | F24C 15/2007 126/299 R |
| RE22,228 | E | * | 12/1942 | Petersen | F24C 15/2042 126/299 R |
| 2,793,712 | A | * | 5/1957 | Graswich | F24C 15/20 126/299 D |
| 3,075,335 | A | | 1/1963 | Bandlow | |
| 3,698,378 | A | * | 10/1972 | Rosenberg | F24C 3/047 126/299 D |
| 5,000,160 | A | | 3/1991 | Dunlop et al. | |
| 5,209,697 | A | | 5/1993 | Hurst et al. | |
| 6,119,680 | A | | 9/2000 | Barritt | |

(Continued)

FOREIGN PATENT DOCUMENTS

| | | |
|---|---|---|
| DE | 3236924 A1 | 4/1983 |
| EP | 1674799 A1 | 6/2006 |

(Continued)

OTHER PUBLICATIONS

European Patent Application No. 14184951.3 filed Oct. 20, 2014. European Extended Search Report, mail date Apr. 1, 2015, re: same.

*Primary Examiner* — Gregory Huson
*Assistant Examiner* — Daniel E Namay

(57) ABSTRACT

A vent hood kit comprises a canopy assembly having an intake end and an outlet end, a blower housing selectively and alternatively coupled with the exhaust end of the canopy assembly in an in-line position and an external position, a blower assembly disposed within a blower housing and in communication with the intake end in both the in-line and external positions and an exhaust duct adapter of the blower housing is configured to be in communication with the intake end in both the in-line and external positions.

20 Claims, 11 Drawing Sheets

(56) References Cited

U.S. PATENT DOCUMENTS

| | | | | |
|---|---|---|---|---|
| 6,647,978 | B1 | 11/2003 | Khosropour et al. | |
| 6,715,484 | B2 | 4/2004 | Khosropour et al. | |
| 6,895,956 | B2 | 5/2005 | Fioriti et al. | |
| 6,899,095 | B2 * | 5/2005 | Livchak | F15D 1/02 126/299 D |
| 8,695,585 | B2 * | 4/2014 | Kessler | F23J 15/025 110/203 |
| 8,857,424 | B2 * | 10/2014 | Lambertson | B08B 15/02 126/299 D |
| 2004/0035411 | A1 * | 2/2004 | Livchak | F15D 1/02 126/299 R |
| 2006/0090746 | A1 * | 5/2006 | Lee | F24C 15/2028 126/299 D |
| 2007/0155299 | A1 * | 7/2007 | Baehr | F24C 15/2071 454/67 |
| 2007/0193574 | A1 * | 8/2007 | Kessler | F23J 15/025 126/299 D |
| 2007/0227526 | A1 | 10/2007 | Liao | |
| 2009/0042500 | A1 * | 2/2009 | Robison | A61L 9/20 454/67 |
| 2009/0247062 | A1 | 10/2009 | Chen | |
| 2010/0126494 | A1 * | 5/2010 | Lambertson | B08B 15/02 126/299 D |

FOREIGN PATENT DOCUMENTS

| | | | | |
|---|---|---|---|---|
| EP | 2110611 | A2 | 10/2009 | |
| JP | 06129682 | A * | 5/1994 | |
| JP | EP 0762061 | A1 * | 3/1997 | F24C 15/20 |
| JP | CA 2176521 | C * | 12/2003 | |

* cited by examiner

MODULAR VENT HOOD BLOWER KIT FOR IN-LINE OR EXTERNAL APPLICATION

BACKGROUND

The present device generally relates to vent or range hood blowers, and more specifically, to a modular vent or range hood blower that is adaptable to a variety of applications.

SUMMARY

In at least one aspect of the present disclosure, a vent hood kit comprises a canopy assembly having an intake end and an outlet end. A removable blower assembly is configured to be selectively and alternatively installed in an in-line position and an external position, wherein the blower assembly is in communication with the intake end in the in-line and external positions. A main blower housing is fixedly coupled to the outlet end of the canopy assembly. The main blower housing has an exhaust duct adapter and is configured to receive the removable blower assembly in the in-line position. An accessory blower housing is spaced distally from the canopy assembly and has an inlet duct adapter selectively engaged with the exhaust duct adapter. The accessory blower housing is configured to receive the removable blower assembly in the external position.

In at least another aspect of the present disclosure, a vent hood kit comprises a canopy assembly having an intake end and an outlet end, and a blower housing selectively and alternatively coupled with the outlet end of the canopy assembly in an in-line position and an external position. A blower assembly is disposed within a blower housing and in communication with the intake end in both the in-line and external positions. An exhaust duct adapter of the blower housing is configured to be in communication with the intake end in both the in-line and external positions.

In at least another aspect of the present disclosure, a vent hood kit comprises a blower housing having a plurality of walls defining an inner volume, a blower assembly disposed within the volume, and an inlet aperture defined within one of the plurality of walls. A canopy assembly includes an intake end and an outlet end, wherein the outlet end is configured to engage the inlet aperture when the blower housing is in one of an in-line position defined by the blower housing being directly connected to the canopy assembly and an external position defined by the blower housing being distal from the canopy assembly. The blower assembly is in communication with the intake end when the blower housing is in either of the in-line position and the external position. At least one accessory cover is configured to engage at least one of the inlet aperture of the blower housing and the outlet end of the canopy housing when the blower housing is disposed in the external position.

These and other features, advantages, and objects of the present device will be further understood and appreciated by those skilled in the art upon studying the following specification, claims, and appended drawings.

DETAILED DESCRIPTION OF EMBODIMENTS

Figure 1:
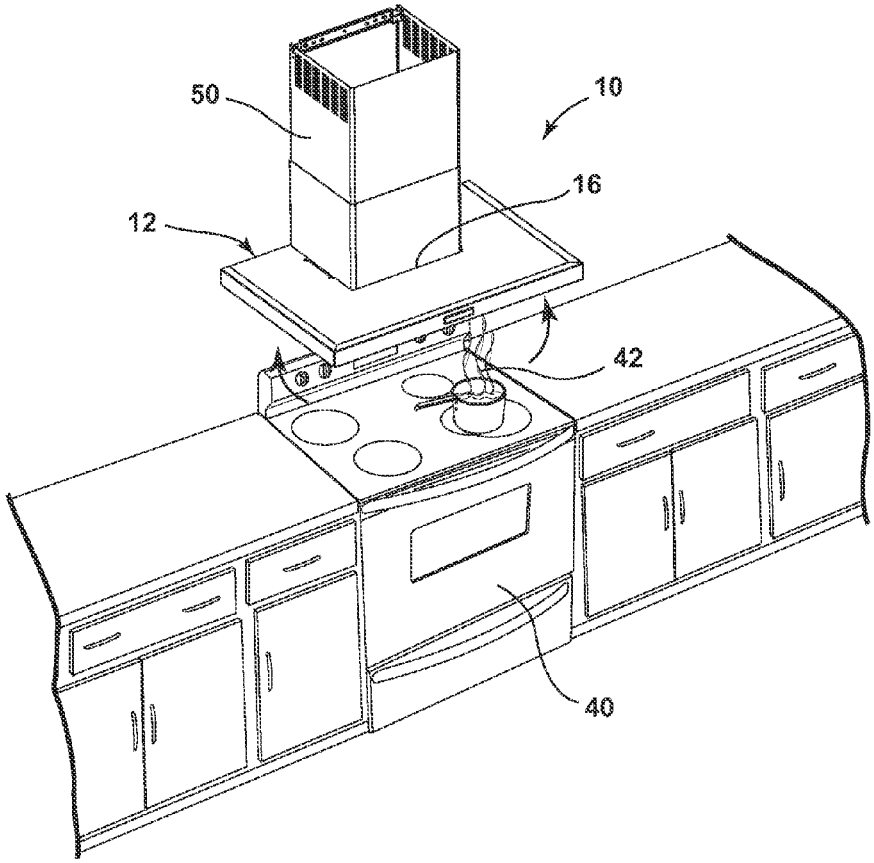
FIG. 1 is a top perspective view of one embodiment of the vent hood kit installed in a kitchen.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 5:
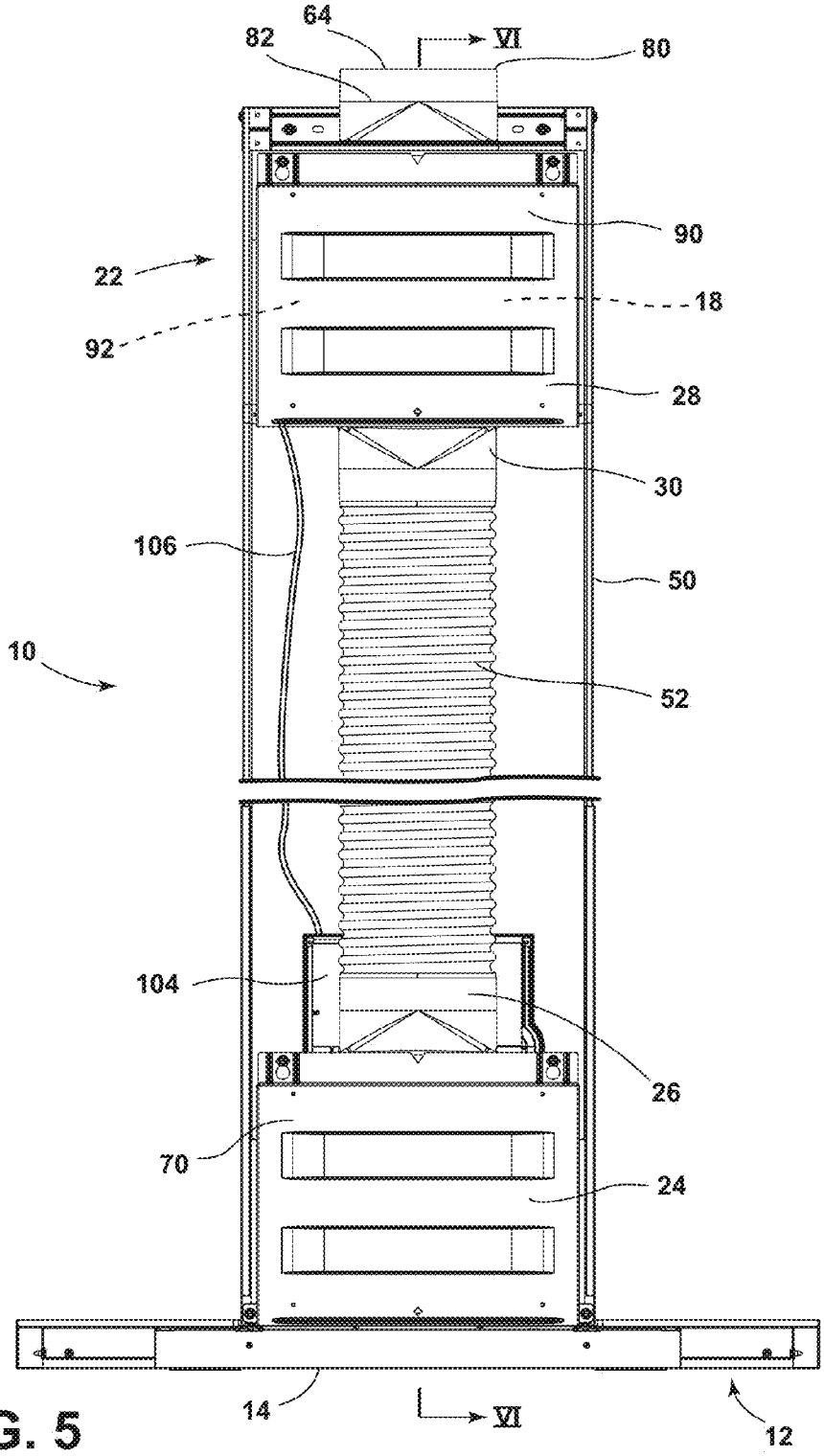
FIG. 5 is a rear elevation view of an alternate embodiment of the vent hood kit with the blower assembly placed in an external position within the accessory blower housing.

As illustrated in FIGS. 1-7, the reference numeral 10 generally refers to a vent hood kit 10 that includes a canopy assembly 12 having an intake end 14 and an outlet end 16. A selectively removable blower assembly 18 is configured to be selectively and alternatively installed in either an in-line position 20 (FIG. 3) or an external position 22 (FIG. 5). The blower assembly 18 is configured to be in fluid communication with the intake end 14 of the canopy assembly 12 in both the in-line position 20 and external position 22. A main blower housing 24 is fixedly coupled to the outlet end 16 of the canopy assembly 12. The main blower housing 24 includes an exhaust duct adapter 26 and is configured to receive the removable blower assembly 18 in the in-line position 20. An accessory blower housing 28 is configured to be spaced distally from the canopy assembly 12 and includes an inlet duct adapter 30 selectively engaged with the exhaust duct adapter 26 of the main blower housing 24. The accessory blower housing 28 is configured to receive the removable blower assembly 18 in the external position 22.

Referring again to FIG. 1, the vent hood kit 10 is generally configured for installation in residential and commercial kitchens, typically positioned proximate cooking appliances 40 such as ranges, stoves, ovens, grills and other similar cooking equipment, where steam 42, grease, particulate matter and other heated and/or evaporated material rises as food items are being cooked. The vent hood kit 10 can be installed on a wall or can be suspended from the ceiling, depending upon the design of the kitchen space and the location of various appliances within the kitchen space. Alternatively, the vent hood kit 10 can be installed within a cabinet over a cooking appliance. In such an embodiment, the canopy assembly 12 can be installed on the underside of a cabinet such that the intake end 14 of the canopy assembly 12 is located over the cooking appliance and the blower assembly 18 is disposed either within the cabinet in the in-line position 20, or above the cabinet in the external position 22.

Figure 2:
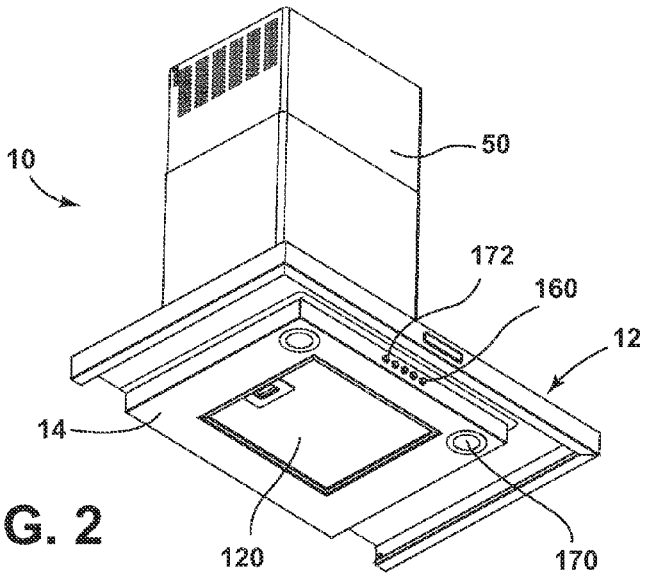
FIG. 2 is a bottom perspective view of another embodiment of the vent hood kit.
Figure 3:
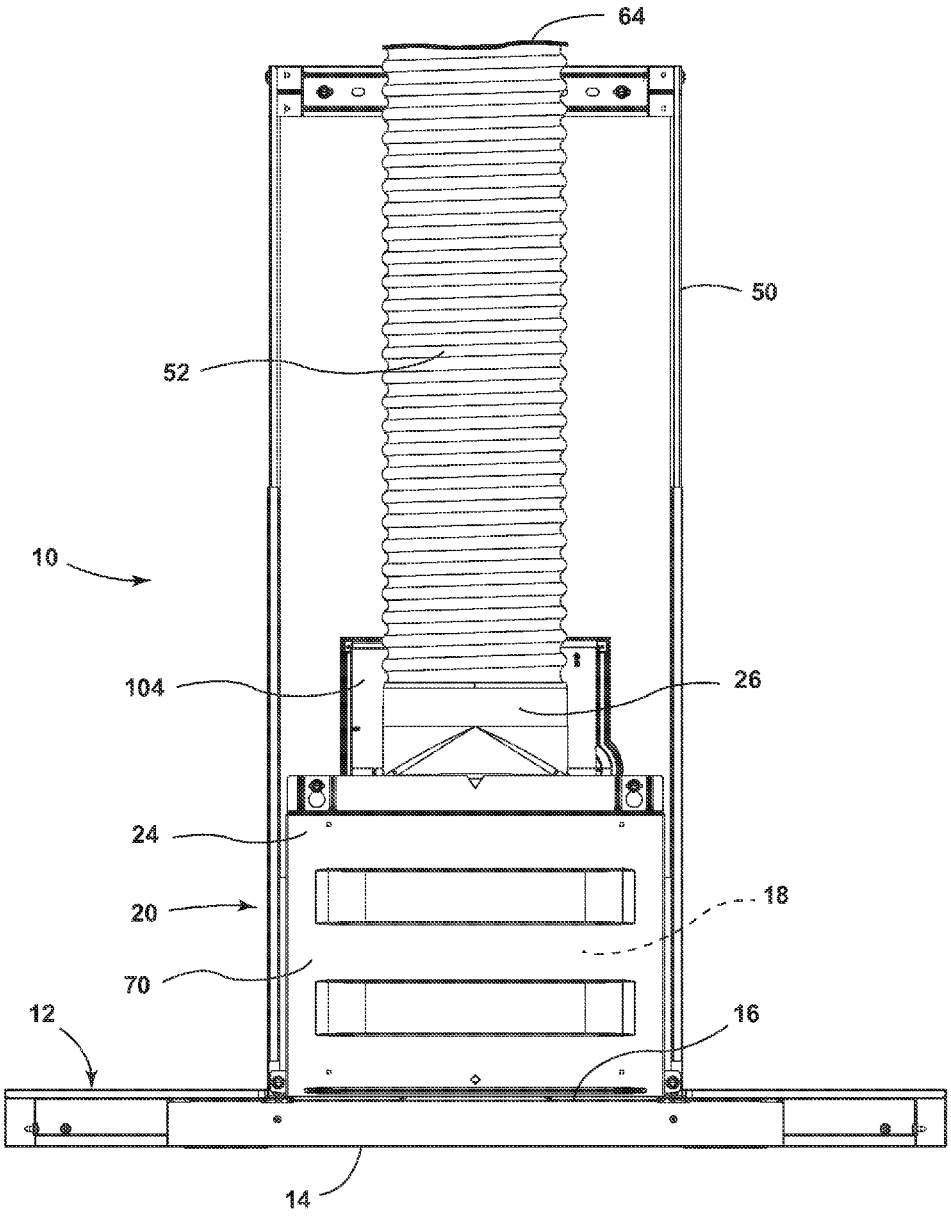
FIG. 3 is a rear elevation view of another embodiment of the vent hood kit with the blower assembly in the in-line position.
Figure 4:
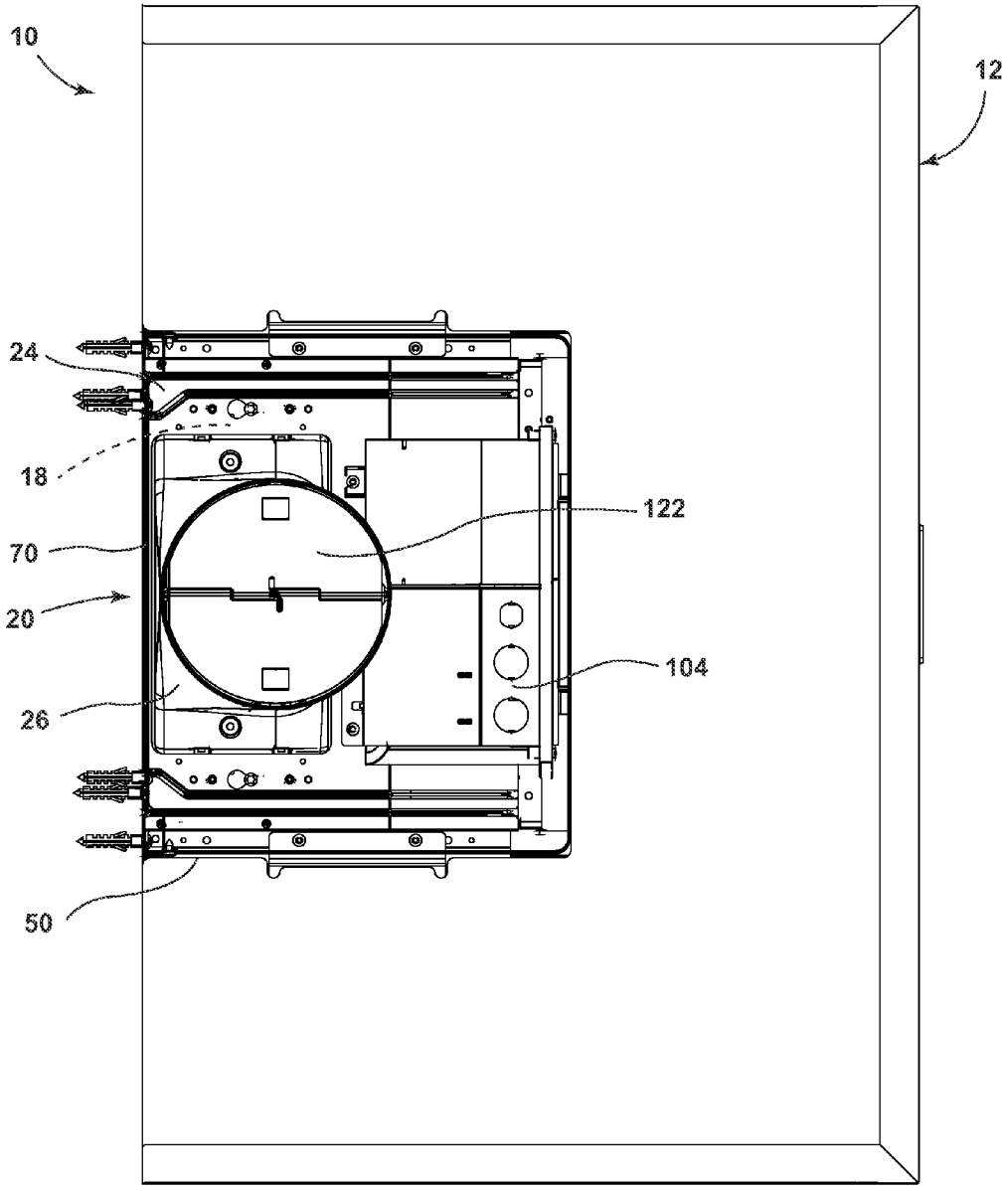
FIG. 4 is a top plan view of the vent hood kit of FIG. 3.

Referring now to FIGS. 1-3, the vent hood kit 10 includes an outer duct 50 that extends upward from the canopy assembly 12, wherein the outer duct 50 is configured to conceal the main and accessory blower housings 24, 28, inner duct 52, and other various components of the vent hood kit 10, as will be described more fully below. The canopy assembly 12 extends laterally from the outer duct 50, such that the canopy assembly 12 can capture fumes and vapors that rise from various appliances (i.e., a stove). The canopy assembly 12 can include a substantially cuboidal shape with a substantially horizontal profile. It is contemplated that other configurations of the canopy assembly 12 can be included, wherein such alternate configurations include, but are not limited to, trapezoidal geometries, conical geometries, cylindrical geometries, other arcuate geometries, irregular geometries, and other configurations that allow for the collection of gas, such as fumes, steam, vapors, other evaporated material, and fine particular matter, that emanate from cooking appliance 40, and to allow for the direction of gas, up into the vent hood kit 10. It is also contemplated that the outer duct 50 may have a substantially cuboidal, cylindrical, or arcuate configuration.

Referring again to FIGS. 2-4, the vent hood kit 10 is shown in an in-line position 20 where the accessory blower housing 28 is disengaged from the exhaust duct adapter 26. The blower assembly 18 being configured to deliver gas from the intake end 14 of the canopy assembly 12, through an in-line aperture 62 of the exhaust duct adapter 26 and out an exhaust vent 64 at a position distal from the intake end 14. When disposed in the in-line position 20, the accessory blower housing 28 may not be used. An inner duct 52 can be coupled with the exhaust duct adapter 26 of the main blower housing 24, and run to the exhaust vent 64, wherein the gas can be expelled from the vent hood kit 10. The main blower housing 24 includes a plurality of housing walls 70 that define an interior volume 72, wherein the blower assembly 18 is disposed within the interior volume 72 and coupled with at least one of the plurality of housing walls 70. As will be more fully described below, the blower assembly 18 is configured to be easily removed from and installed within the main and accessory blower housings 24, 28 to define the in-line and external positions 20, 22 of the vent hood kit 10.

Figure 6:
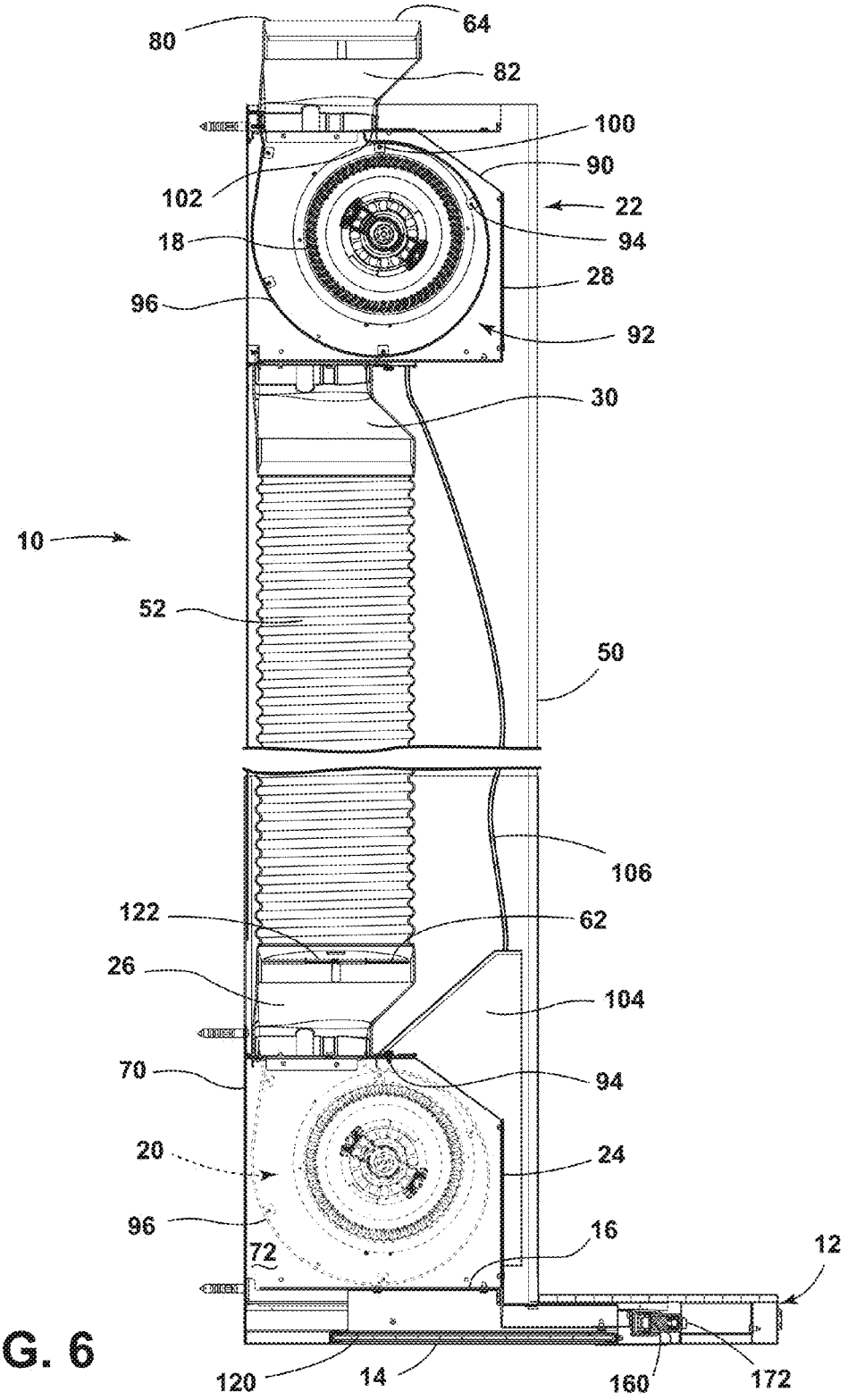
FIG. 6 is a cross-sectional view of the vent hood kit of FIG. 5 taken along line VI-VI.
Figure 7:
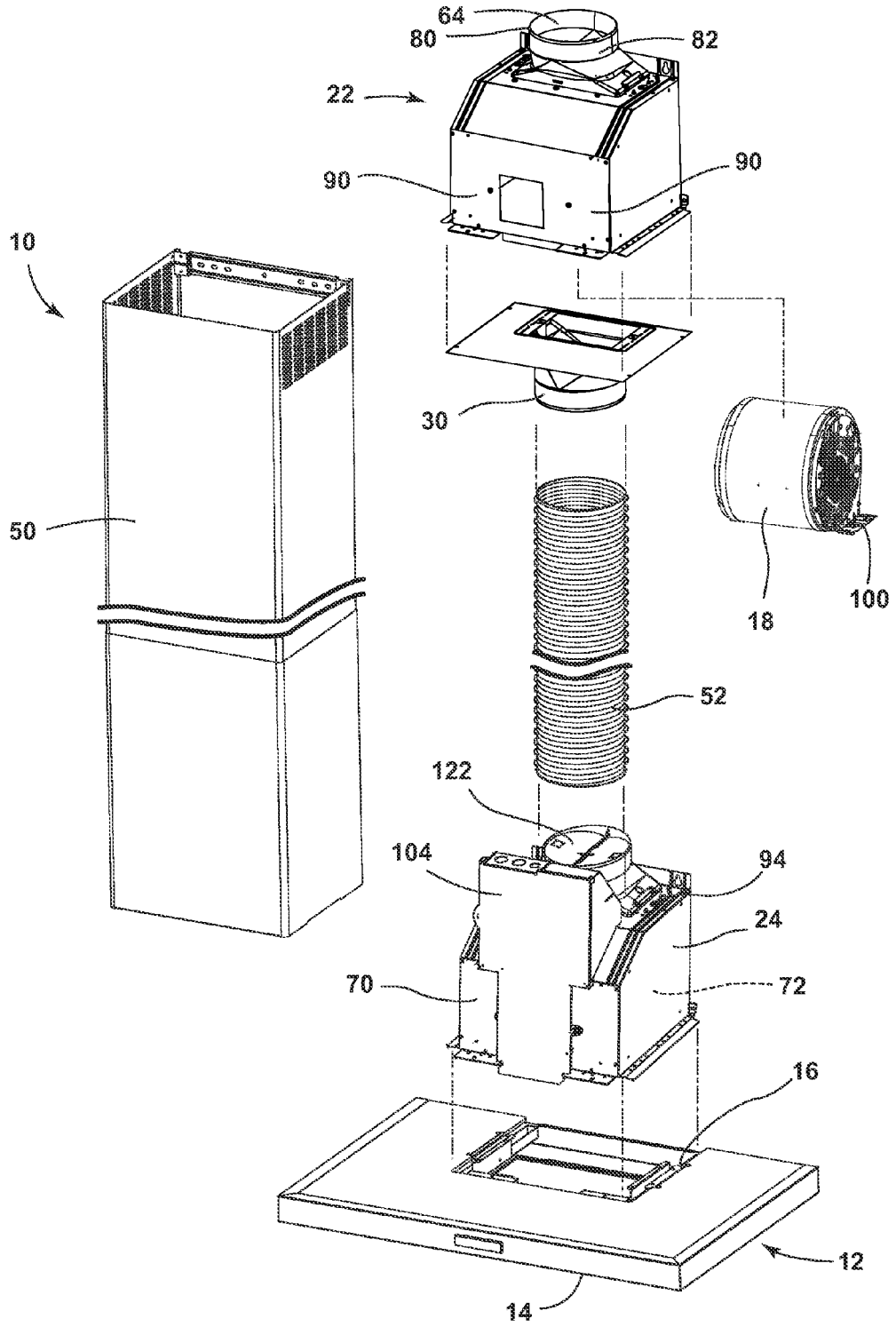
FIG. 7 is an exploded perspective view of the vent hood kit of FIG. 5.
Figure 8:
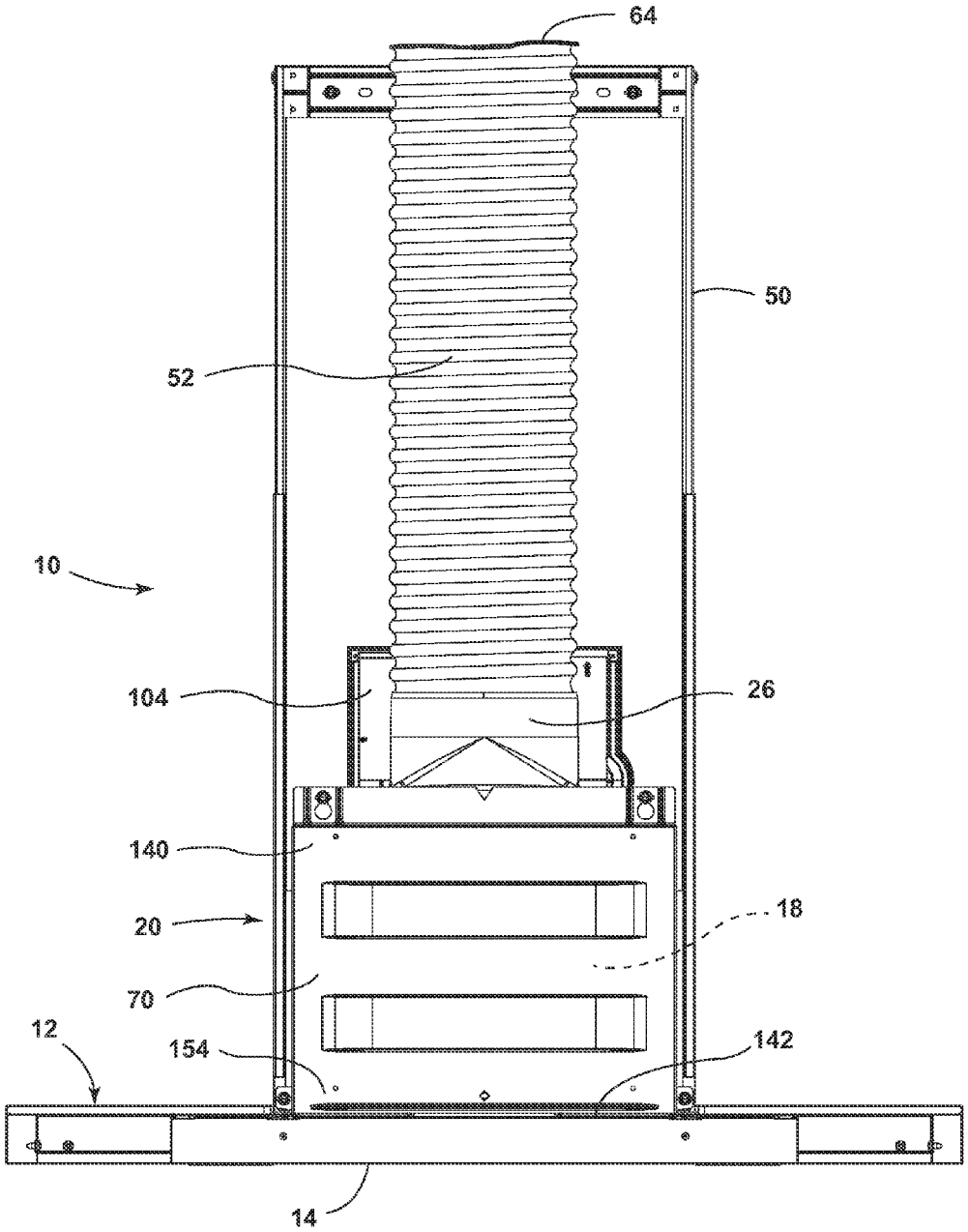
FIG. 8 is a rear elevation view of another embodiment of the vent hood kit with the movable blower housing in the in-line position.
Figure 9:
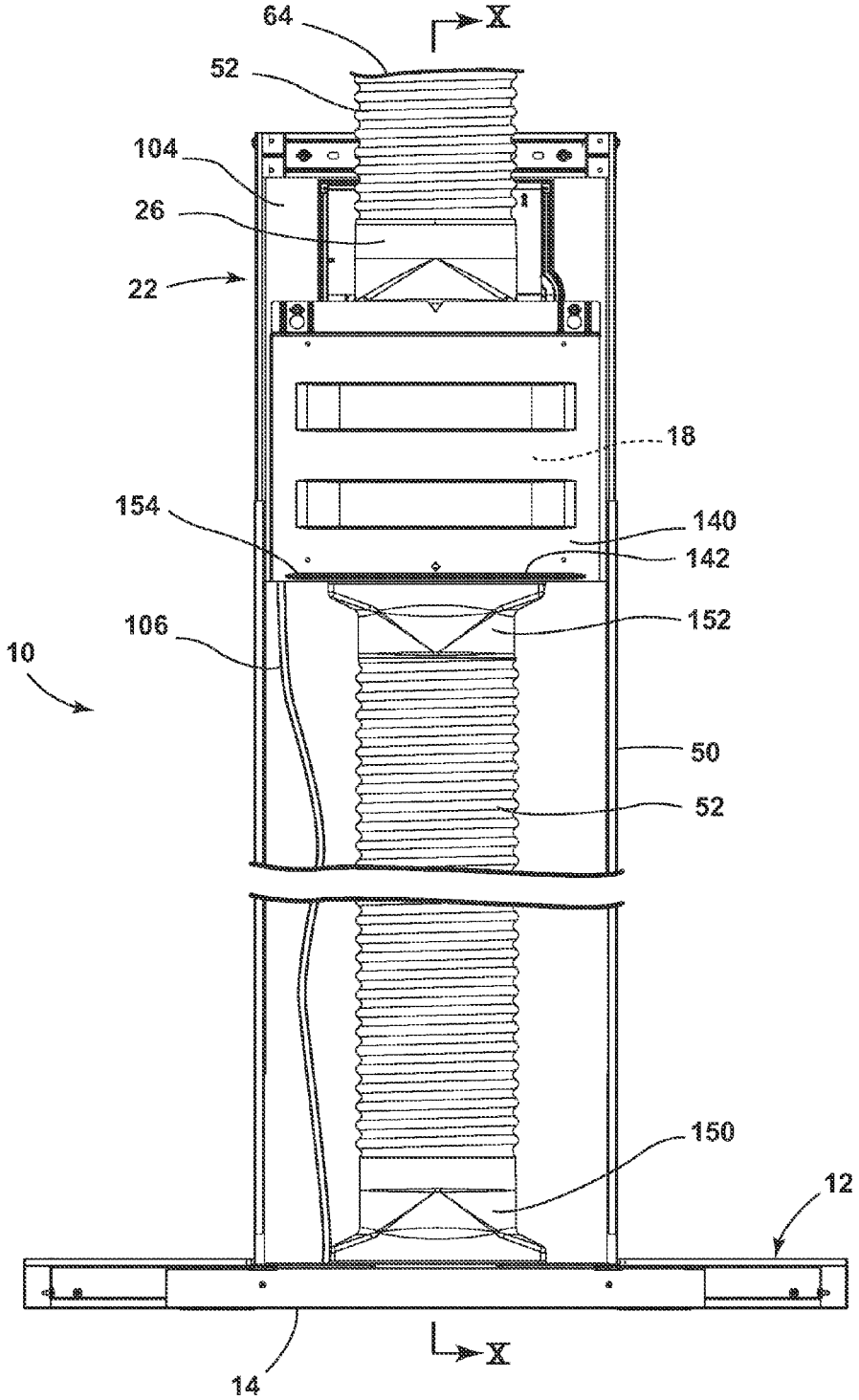
FIG. 9 is a rear elevation view of the vent hood kit of FIG. 8 with the movable blower housing disposed in the external position.
Figure 10:
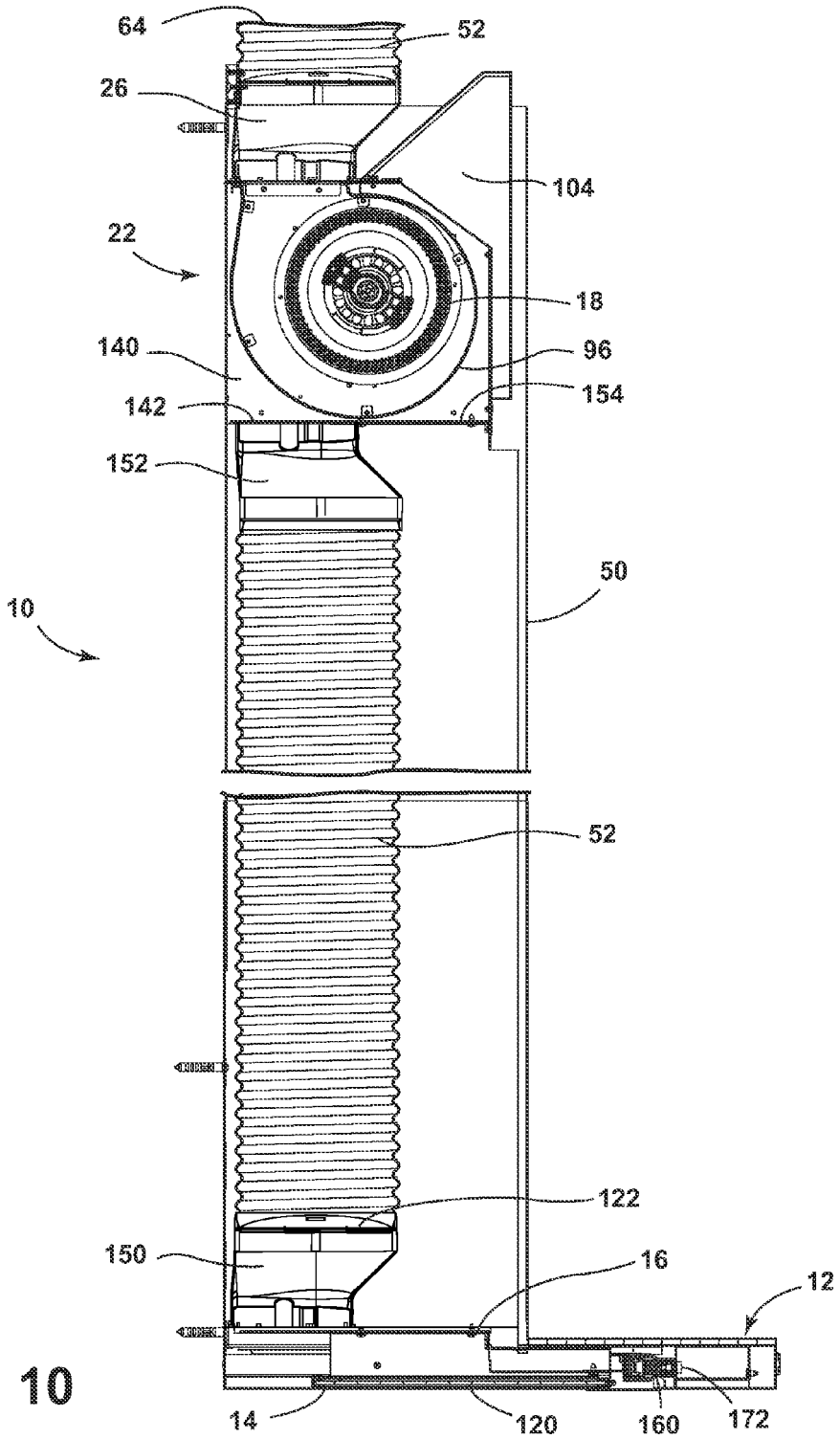
FIG. 10 is a cross-sectional view of the vent hood kit of FIG. 9, taken at line X-X.
Figure 11:
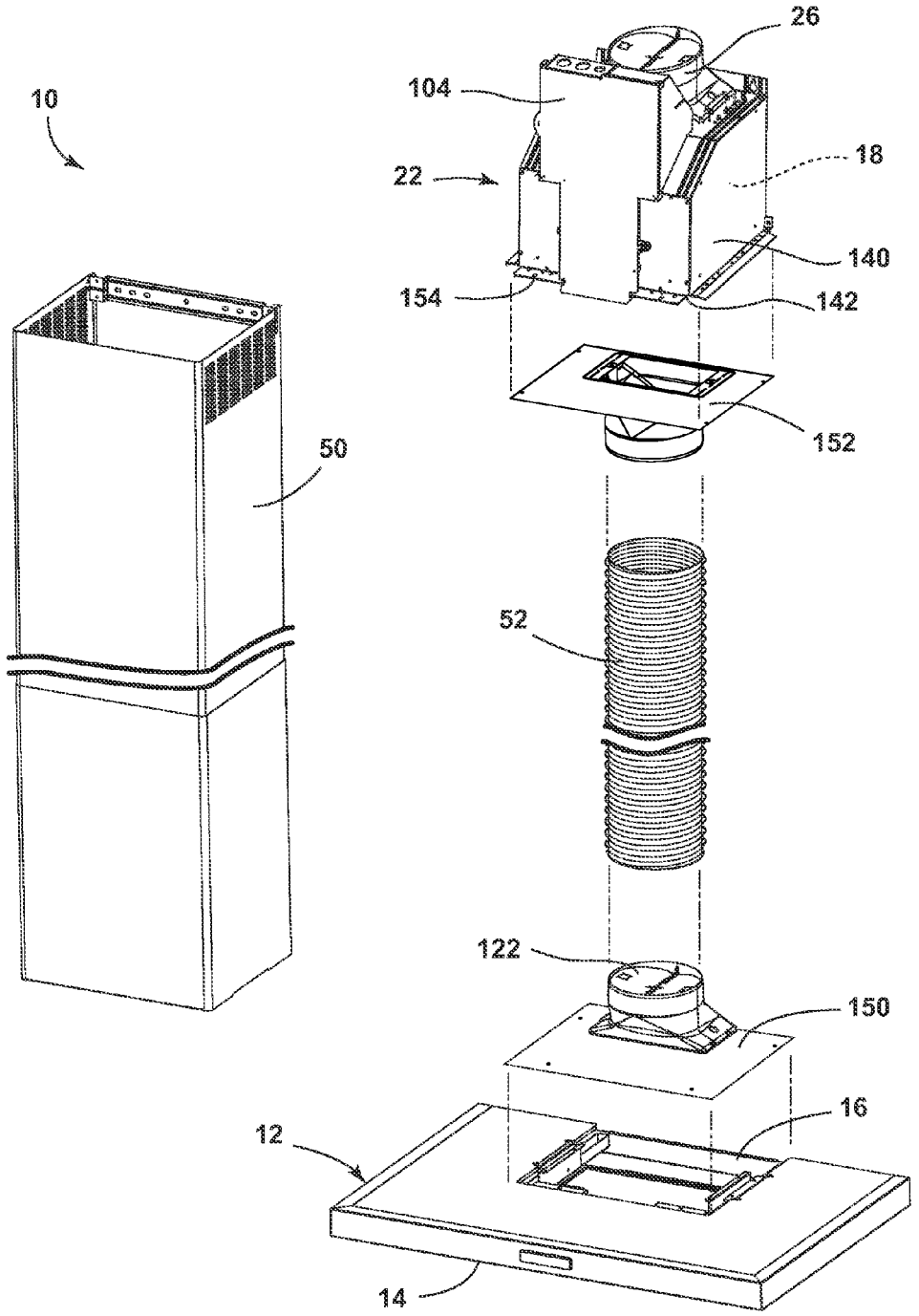
FIG. 11 is an exploded perspective view of the vent hood kit of FIG. 9.

Referring now to FIGS. 5-7, the accessory blower housing 28 can be installed within the outer duct 50 and coupled with the main blower housing 24 in either the in-line position 20 or the external position 22. As discussed above, when the vent hood kit 10 is disposed in the in-line position 20, the blower assembly 18 is positioned within the main blower housing 24. Alternatively, when the blower assembly 18 is disposed within the external position 22, the blower assembly 18 is disposed within the accessory blower housing 28 engaged with the exhaust duct adapter 26, and positioned distal from the canopy assembly 12 and the main blower housing 24. The blower assembly 18 is positioned inside the accessory blower housing 28 and is configured to deliver gas from an area proximate the intake end 14 of the canopy assembly 12, through an external aperture 80 defined in an accessory exhaust duct adapter 82 of the accessory blower housing 28, and to an area distal from the intake end 14 of the canopy assembly 12. The inner duct 52 is configured to extend from the exhaust duct adapter 26 of the main blower housing 24 to the inlet duct adapter 30 of the accessory blower housing 28, when the blower assembly 18 is disposed in the external position 22. In this manner, the blower assembly 18 is configured to be selectively disposed between the in-line and external positions 20, 22, within the main blower housing 24 and the accessory blower housing 28, respectively. It is contemplated that the inlet duct adapter 30 is a separate panel that is attached to the lower end of the accessory blower housing 28.

As illustrated in FIGS. 5-7, the accessory blower housing 28 includes a plurality of accessory housing walls 90 that define an accessory interior volume 92, wherein the blower assembly 18 is disposed within the accessory interior volume 92 and coupled to the at least one of the plurality of accessory housing walls 90 in the external position 22. The plurality of housing walls 70 and the plurality of accessory housing walls 90 are configured to selectively and alternatively receive the blower assembly 18 to define the in-line position 20 and external position 22, respectively.

As illustrated in FIG. 6, the blower assembly 18 includes an arcuate wall 96 designed to fit inside either the main blower housing 24 or the accessory blower housing 28. In such an embodiment, the arcuate wall 96 defines receptacle for the blower assembly 18. It is contemplated that, in various embodiments, the inner wall 96 is fixedly coupled to the blower assembly 18 such that the inner wall 96 is removed with the blower assembly 18 and can be moved between the main and accessory blower housings 24, 28 as a unit. In this configuration, the inner wall 96 substantially protects the blower assembly 18 when the blower assembly is removed from the main blower housing 24 and reinstalled within the accessory blower housing 28 and vice versa.

Referring again to FIG. 6, it is contemplated that the blower assembly 18 can be conveniently removed from the main blower housing 24 and installed within the accessory blower housing 28. This can be accomplished by removing one or more fastening members 100 that couple the blower assembly 18 to either the main or accessory blower housings 24, 28. The blower assembly 18 can then be removed from one of the main or accessory blower housings 24, 28 and inserted within the other of the accessory or main blower housings 28, 24. In this manner, the blower assembly 18, which is typically an electrical blower, can be disconnected from one electrical power source and reconnected to another power source of the other location, as described above. In this manner, each of the main and accessory blower housings 24, 28 include an electrical receptacle 102 that is configured to receive a portion of the blower assembly 18, such that once the blower assembly 18 and the electrical receptacle 102 are in electrical communication, electrical power can be delivered to the blower assembly 18 in either the main or accessory blower housings 24, 28.

As shown in FIGS. 3-7, the main blower housing 24 includes an electrical module 104 that houses the electrical components of the vent hood kit 10. When the vent hood kit 10 is positioned in the in-line position 20, the blower assembly 18 can be coupled directly to the electrical components disposed within the electrical module 104 of the main blower housing 24. Alternatively, when the blower assembly 18 is disposed within the accessory blower housing 28, electrical wiring 106 must be extended from the electrical module 104 of the main blower housing 24 to the accessory blower housing 28 proximate the electrical receptacle 102 of the accessory blower housing 28. This configuration allows electrical power to run from the main blower housing 24 to the accessory blower housing 28 without requiring multiple electrical modules 104.

It is contemplated that the vent hood kit 10 includes a spacer panel 94 that can be directly connected to either the main or accessory blower housing 24, 28 when the blower assembly 18 is removed. After removal of the blower assembly 18, the main or accessory blower housing 24, 28 may have a hole in the housing walls 70 where the blower assembly 18 was installed. The spacer panel 94 can be installed to occupy this space and substantially prevent gas from being directed out of the vent hood kit 10 in an undesired manner.

In various embodiments, the vent hood kit 10 can include two blower assemblies, with a blower assembly 18 disposed in each of the main and accessory blower housings 24, 28. Such an embodiment can be useful where greater amounts of gas need to be removed by the vent hood kit 10, or where the volume of gas that needs to be moved is greater than what a single blower assembly 18 can accommodate.

Referring again to FIGS. 1-6, the vent hood kit 10 can include various filters 120 within either the canopy assembly 12, the main blower housing 24, the accessory blower housing 28, or a combination thereof, to remove particulate matter, grease vapors, and other materials that can inhibit the operation of the blower assembly 18. Additionally, the canopy assembly 12, the main blower housing 24, the accessory blower housing 28, or a combination of the three, can include at least one baffle 122 that is configured to open when the blower assembly 18 is activated, and closed when the blower assembly 18 is deactivated. This baffle 122 is configured to prevent backflow of material that has been removed from proximate the canopy assembly 12 and also prevent foreign material from entering portions of the vent hood kit 10 from the outside atmosphere above the vent hood kit 10 while the vent hood kit 10 is idle.

Referring again to FIGS. 1-6, the exhaust point 64 for the vent hood kit 10 can depend on whether the blower assembly 18 is positioned in either the in-line or external position 20, 22. In the in-line position 20, the exhaust point 64 can be proximate the canopy assembly 12 so that the gas that is removed by the canopy assembly 12 can be expelled either back into the kitchen area after being filtered, or expelled laterally through a wall to the outside environment. Alternatively, when the blower assembly 18 is disposed in the external position 22, the exhaust point 64 is typically through the ceiling of the kitchen space and out to the external atmosphere through the structure of a building, such as a roof, exterior wall, interior wall or similar structural member of a building. It is contemplated that the blower assembly 18 being in the in-line position 20 can accommodate the evacuation of gas vertically through the roof or horizontally through an exterior wall. In applications where the distance between the canopy assembly 12 and the roof structure of the building is a sufficiently great distance, the external position 22 of the blower assembly 18 can be utilized to draw gas from an area proximate the canopy assembly 12 and evacuate the gas out through the roof of the building. In various embodiments, where gas from the canopy assembly 12 is being removed through a portion of the structure (e.g., a wall or a portion of the roof) in either the in-line or external positions 20, 22, the accessory housing can be configured as an adapter that attaches directly to the structure for receiving the inner duct 52 that extends from the main blower housing 24 to the accessory blower housing 28. In this manner, the accessory blower housing 28 can provide a substantially sturdy connection point for the vent hood kit 10 to couple to the structure of the building and provide a fixed exhaust point 64 for the vent hood kit 10.

Referring now to FIGS. 8-11, in an alternate embodiment, the canopy assembly 12 of the vent hood kit 10 has a movable blower housing 140 that is selectively and alternatively coupled with the outlet end 16 of the canopy assembly 12 in either the in-line position 20 or external position 22. The blower assembly 18 is fixedly disposed within the movable blower housing 140, and in communication with the intake end 14 in both the in-line and external positions 20, 22. An exhaust duct adapter 26 of the movable blower housing 140 is configured to be in communication with the intake end 14 of the canopy assembly 12 in both the in-line and external positions 20, 22.

Referring again to FIGS. 8-11, at least one accessory cover 150 is configured to engage at least one of the inlet aperture 142 of the movable blower housing 140 and the outlet end 16 of the canopy assembly 12 when the movable blower housing 140 is disposed in the external position 22. The at least one accessory cover 150 can include a canopy accessory cover that is configured to be selectively attached to the outlet end 16 of the canopy assembly 12 when the blower assembly 18 is in the external position 22. An inlet accessory cover 152 can also be included that is configured to be selectively attached to an inlet end 154 of the movable blower housing 140 when the blower assembly 18 is in the external position 22, such that the accessory cover 150 and the inlet accessory cover 152 are engaged by the inner duct 52. It is contemplated that the inner duct 52 can be either rigid or flexible ductwork, or a combination of rigid and flexible ductwork.

Referring again to FIGS. 8-11, when in the in-line position 20, the inlet end 154 of the movable blower housing 140 is attached directly to the outlet end 16 of the canopy assembly 12. The inner duct 52 is then attached to an exhaust adapter of the moveable blower housing 140, where the inner duct 52 extends toward the exhaust vent 64 of the vent hood kit 10. As discussed above in previous embodiments, the exhaust vent 64 of the vent hood kit 10 can be proximate the canopy assembly 12, either into the kitchen space or through a wall or other similar structure of the building, or the exhaust vent 64 can be distal from the canopy assembly 12 through the roof structure or external wall of the building. The configuration of the exhaust vent 64 depends upon the configuration of the kitchen space, the cooking appliances 40 used, and other factors.

As shown in FIGS. 3 and 8-11, the configuration of the vent hood kit 10 in the in-line position 20 in the current embodiment is similar to that of the in-line position 20 in previously discussed embodiments, where the accessory blower housing 28 is not present within the application of the vent hood kit 10. According to FIG. 3, the main blower housing 24 of the previously discussed embodiment is positioned substantially similar to the movable blower housing 140 in the currently discussed embodiment (shown in FIG. 8). In this current embodiment, no accessory blower housing 28 is included, and the vent hood kit 10 includes the movable blower housing 140 with the blower assembly 18 fixedly installed within the movable blower housing 140. The movable blower housing 140 can be either fixedly attached to the canopy assembly 12 or moved distal to the canopy assembly 12 to define the external position 22. The movable blower housing 140 includes the electrical module 104 that is fixedly attached to and moves along with the movable blower housing 140 between the in-line position 20 and external position 22. Electrical wiring 106 extends from the electrical module 104 to the canopy assembly 12 when the movable blower housing 140 is disposed in the external position 22 to place the control 160 of the vent hood kit 10 in communication with the blower assembly 18. It is contemplated that in various embodiments that the electrical module 104 can be coupled to the canopy assembly 12 with electrical wiring 106 extending from the electrical module 104 to the canopy assembly 12 and to the moveable blower housing 140. The control 160 is also in communication with other aspects of the vent hood kit 10 and portions of the building's systems related to the vent hood kit 10, as will be described more fully below.

Referring again to FIGS. 8-11, when the movable blower housing 140 is disposed in the external position 22, an inlet aperture 142 is defined within the movable blower housing 140 where the movable blower housing 140 connects with the canopy assembly 12 in the in-line position 20. The inlet accessory cover 152 is configured to cover the inlet aperture 142 where the inlet aperture 142 is disposed within the inlet end 154 of the movable blower housing 140. The movable blower housing 140 includes a plurality of walls that define an inner volume where the blower assembly 18 is disposed within the inner volume and in communication with the intake end 14 of the canopy assembly 12. The canopy assembly 12, as discussed above, includes an intake end 14 and an outlet end 16, where the outlet end 16 is configured to engage the inlet aperture 142 of the movable blower housing 140 in both the in-line position 20 and external position 22. When the movable blower housing 140 is disposed in the external position 22, the accessory cover 150 engages the outlet end 16 of the canopy assembly 12 to cover the opening in the outlet end 16 of the canopy assembly 12 that is exposed when the movable blower housing 140 is moved to the external position 22.

In the various embodiments, the placement of the movable blower housing 140 in the in-line position 20 or external position 22 can depend upon several factors, such as the distance between the canopy assembly 12 and the exhaust vent 64 of the vent hood kit 10. Where the distance between the canopy assembly 12 and the exhaust vent 64 is a greater vertical distance, the external position 22 may be desired. Alternatively, where the exhaust vent 64 is proximate the canopy assembly 12, the in-line position 20 may be utilized. It is contemplated that the in-line position 20 can be used in conjunction with an exhaust vent 64 that is above the canopy assembly 12, such as in the roof of the structure.

When the movable blower housing 140 is disposed in the in-line position 20, the accessory cover 150 and the inlet accessory cover 152 are not typically used. Although, it is contemplated that the inlet accessory cover 152 can be used as an adapter to receive the inner duct 52 that extends from the movable blower housing 140 to the structure of the building. The inlet accessory cover 152 can be used to provide a secure position to fix the exhaust vent 64 to the building structure.

In the various embodiments discussed above and as shown in FIGS. 1-11, the external components of the vent hood kit 10, such as the canopy assembly 12 and the outer duct 50 can be made of various materials that can provide an aesthetic finish to the vent hood kit 10. These materials include, but are not limited to, stainless steel, coated metals, composites, ceramics, plastics, and other substantially sturdy and substantially heat resistant materials that can provide a decorative finish to the vent hood kit 10. The inner duct 52 that extends between the main blower housing 24 and the accessory blower housing 28 can be flex duct, a more rigid duct, or other substantially heat resistant ductwork. It is contemplated that the vent hood kit 10 can be installed without the outer duct 50 to expose the main and accessory blower housings 24, 28 and the inner duct 52 extending therebetween where such an aesthetic is desired. In various other embodiments, the structure of the building itself can be used to conceal various components of the vent hood kit 10.

According to the various embodiments, as shown in FIGS. 1-11, various turbulence reduction mechanisms can be included in the vent hood kit 10 to assist the air and gas in moving through the vent hood kit 10 during operation. These mechanisms are designed to direct the flow of air and gas through the components of the vent hood kit 10 so as to limit or substantially avoid impediments to the substantially smooth flow of air through the vent hood kit 10. In so doing, these turbulence reduction mechanisms can reduce vibrations and noise within the vent hood kit 10, and can also increase the efficiency of the vent hood kit 10. These mechanisms can be disposed in any of the vent hood kit 10 components, including, but not limited to, the main, accessory or movable blower housing 24, 28, 140, the inner duct 52, the exhaust or inlet duct adapters 26, 30, the canopy or inlet accessory covers 150, 152, among others. The turbulence reduction mechanisms can include, but are not limited to, strakes, baffles 122, vanes, flow straighteners, as well as other similar mechanisms.

It is contemplated that the various components of the vent hood kit 10 can include noise reduction materials and mechanisms that are configured to prevent the vent hood kit 10 from exceeding a predetermined noise level during operation. These noise reduction mechanisms and materials can be disposed within the components of the vent hood kit 10 and along the path of travel of air and gas that is moved through the vent hood kit 10 during operation. Additional noise dampening or noise reducing mechanisms and materials may be desired in either the in-line position 20 or external position 22. These noise dampening mechanisms can include, but are not limited to, silencers, sound traps, attenuators, acoustic louvers, and other similar mechanisms. Noise reducing materials for the vent hood kit 10 components can include, but are not limited to, perforated absorptive liners, acoustic panels, noise insulated ductwork, as well as other similar noise reducing materials. Typically, in the external position 22 of the blower assembly 18, the noise level released by the canopy assembly 12 is usually less due to the distal position of the blower assembly 18 relative to the canopy assembly 12.

Referring again to FIGS. 1-11, in the various embodiments of the vent hood kit 10 described above, the vent hood kit 10 includes the control 160 that is configured to operate the blower assembly 18, in either the in-line or external positions 20, 22. The control can be disposed on a portion of the canopy assembly 12 so that the user of various cooking appliances 40 can readily access the control to adjust the speed of the blower assembly 18 and the volume of gas collected by the canopy assembly 12 and the vent hood kit 10. It is contemplated that a remote control can also be configured to operate the blower assembly 18. It is further contemplated that the vent hood kit 10 can include an automatic control that senses various aspects of the environment surrounding a cooking appliance 40, such as temperature, humidity level, air composition, and other similar environmental factors.

In various embodiments, the control 160 for the vent hood kit 10 can also include a mechanism in communication with a fire suppression system of the vent hood kit 10 that can be manually activated, automatically activated, or both, depending upon the configuration of the kitchen, cooking appliances 40, and the design of the overall space. Various independent fire suppression devices can be incorporated directly into the vent hood kit 10 or can be separate systems that are disposed in the vent hood kit 10. It is also contemplated that the canopy assembly 12 can include various lighting fixtures 170 operated by the control to provide adequate illumination to a cooking surface disposed below the canopy assembly 12. Various graphic interfaces and other indicia 172 can be placed within the canopy assembly 12 proximate the control 160 to provide various information about the vent hood kit 10, as well as the environment surrounding the vent hood kit 10, such as temperature, cook time, status information regarding the vent hood kit 10, and other status information.

Figure 12:
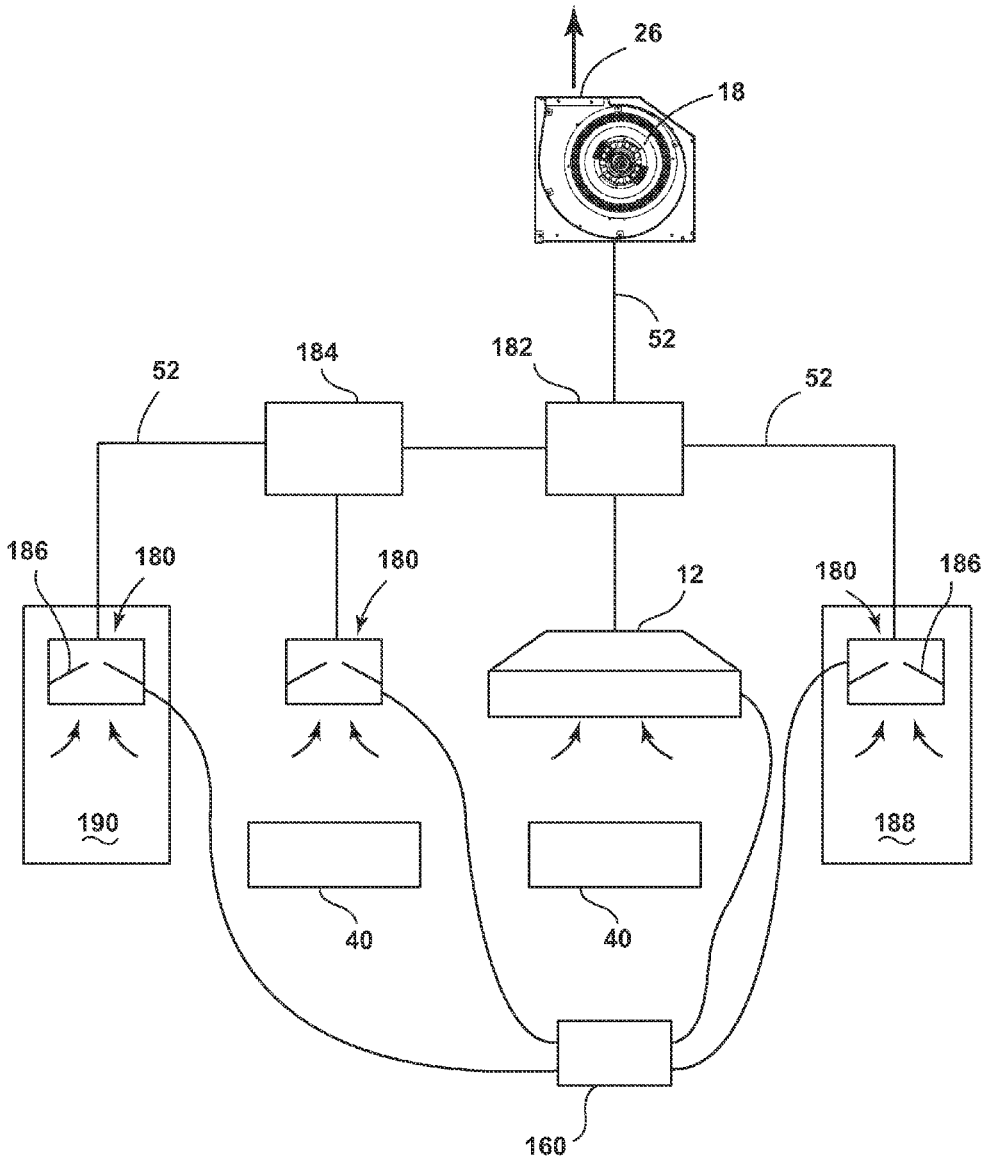
FIG. 12 is a schematic diagram of another embodiment of the vent hood kit installed within multiple rooms of a building.

Referring now to FIG. 12, in various embodiments, the vent hood kit 10 includes one or more intake ports 180 that are configured to be positioned distal from the canopy assembly 12. The intake ports 180 are configured to be in communication with the blower assembly 18 and further configured to deliver steam and other gases from these distal areas to the exhaust duct adapter 26 through an inner duct 52. The inner ducts 52 that lead from the intake ports 180 are placed in communication with the exhaust duct adapter 26 through a primary branch adapter 182 that receives each inner duct 52 from at least one of the intake ports 180. The primary branch adapter 182 can be positioned between the canopy assembly 12 and the exhaust duct adapter 26. By way of explanation, and not limitation, the primary branch adapter 182 can be coupled to any one of the main, accessory or movable blower housings 24, 28, 140 or can be disposed within the outer duct 50 separate from the main, accessory or movable blower housings 24, 28, 140. Secondary branch adapters 184 can be positioned near two or more intake ports 180 where the secondary branch adapter 184 can collect steam and other gases from a larger portion of the building for delivery to the primary branch adapter 182. The primary and secondary branch adapters 182, 184 can be configured to receive a plurality of inner ducts 52 from the canopy assembly 12 and the various intake ports 180. Each of the intake ports 180 can include a baffle 186 that is configured to selectively close and open individual intake ports 180 depending on the need for venting in a particular space. The baffles 186 can also be positioned within the primary and secondary branch adapters 182, 184 to individually control the flow of steam and gas through each intake port 180.

Referring again to FIG. 12, each of the intake ports 180 can be positioned within the same room as the canopy assembly 12 over separate cooking appliances 40. Additionally, one or more of the intake ports 180 can be positioned in separate rooms, such as bathrooms 188, a separate kitchen 190, or other room where steam or other kitchen and domestic gases are to be evacuated. In this manner, the vent hood kit 10 can serve an entire building, residential or commercial, or a significant portion of such a building to evacuate steam from predetermined areas of the building. In various embodiments, the control 160 can be connected to the baffles 186 of the intake ports. In this manner, the control 160 can be used to individually and selectively control the flow of air from each intake port 180 and the canopy assembly 12 through the exhaust duct adapter 26 and out of the building.

Referring again to FIGS. 1-12, in use, the vent hood kit 10 can be purchased from retailers as a singular solution that can be installed in any number of kitchen applications and settings. Upon installation, the vent hood kit 10 can be disposed in the in-line or external position 20, 22 to provide for the desired configuration based upon the set-up of the kitchen space. Once installed, the vent hood kit 10 can be adapted into different configurations, either during construction where design changes may affect the necessary configuration of the vent hood kit 10. Alternatively, the vent hood kit 10 can be adapted after initial installation to account for reconfiguration of the kitchen space such that an in-line position 20 needs to be converted to an external position 22, or vice versa. This configuration can be useful in commercial lease spaces for restaurants where different tenants with different kitchen configurations routinely move in and out of the given leased space. The above-described vent hood kit 10 can provide an economical solution for modifying the vent hood kit 10 to conform to the desired application, based upon the parameters and requirements of the tenant.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A vent hood kit for a kitchen appliance, the vent hood kit comprising:

a canopy assembly having an intake end and an outlet end;

a removable blower assembly configured to be selectively and alternatively installed between an in-line position and an external position, wherein the removable blower assembly is in communication with the intake end in the in-line and external positions;

a main blower housing fixedly coupled to the outlet end of the canopy assembly, the main blower housing having an exhaust duct adapter and configured to receive the removable blower assembly in the in-line position; and an accessory blower housing spaced distally from the canopy assembly and having an inlet duct adapter selectively engaged with the exhaust duct adapter, the accessory blower housing configured to receive the removable blower assembly in the external position, wherein the removable blower assembly is selectively movable between the main and accessory blower housing to selectively define the in-line and external positions while the main blower housing is fixedly coupled to the outlet end of the canopy assembly.

2. The vent hood kit of claim 1, wherein the in-line position is defined by the accessory blower housing being disengaged from the exhaust duct adapter and the removable blower assembly being configured to deliver steam from an area proximate the intake end, through an aperture defined in the exhaust duct adapter and to an area distal from the intake end.

3. The vent hood kit of claim 1, wherein the external position is defined by the accessory blower housing being engaged with the exhaust duct adapter and the removable blower assembly being configured to deliver steam from an area proximate the intake end, through an aperture defined in an accessory exhaust duct adapter of the accessory blower housing and to an area distal from the intake end.

4. The vent hood kit of claim 3, wherein a duct extends from the exhaust duct adapter of the main blower housing to the inlet duct adapter of the accessory blower housing when the removable blower assembly is disposed in the external position.

5. The vent hood kit of claim 1, wherein the removable blower assembly is configured to be selectively disposed between the in-line and external positions.

6. The vent hood kit of claim 1, wherein the main blower housing includes a plurality of housing walls defining an interior volume, wherein the removable blower assembly is disposed within the interior volume and coupled with at least one of the plurality of housing walls in the in-line position.

7. The vent hood kit of claim 6, wherein the accessory blower housing includes a plurality of accessory housing walls defining an accessory interior volume, wherein the removable blower assembly is disposed within the accessory interior volume and coupled to at least one of the plurality of accessory housing walls in the external position.

8. The vent hood kit of claim 7, wherein the plurality of housing walls defines an in-line receptacle and the plurality of accessory housing walls defines an accessory receptacle, and wherein the main blower housing is selectively and alternatively received by the in-line receptacle and the accessory receptacle in the in-line and external positions, respectively.

9. The vent hood kit of claim 1, wherein a control is configured to operate the removable blower assembly when the removable blower assembly is in either of the in-line and external positions, and wherein a turbulence reduction mechanism is disposed between the intake end of the canopy assembly and one of the exhaust duct adapter of the main blower housing and an accessory exhaust duct adapter of the accessory blower housing.

10. A vent hood kit comprising:

a canopy assembly having an intake end and an outlet end;

a blower housing selectively and alternatively coupled with the outlet end of the canopy assembly in one of an in-line position and an external position;

a blower assembly fixedly disposed within the blower housing and in communication with the intake end in both the in-line and external positions; and an exhaust duct adapter of the blower housing configured to be in communication with the intake end in both the in-line and external positions, wherein the blower assembly and blower housing are selectively operable between the in-line and external positions; and a canopy accessory cover that is selectively attached directly to the outlet end of the canopy assembly in the external position, wherein the blower housing is selectively attached directly to the outlet end in the in-line position, the in-line position being free of the canopy accessory cover.

11. The vent hood kit of claim 10, further comprising:

an inlet accessory cover configured to be selectively attached to an inlet end of the blower housing when the blower assembly is in the external position, wherein the canopy accessory cover and the inlet accessory cover are engaged with one another.

12. The vent hood kit of claim 11, wherein a duct extends between the canopy accessory cover and the inlet accessory cover when the blower assembly is disposed in the external position, wherein at least one of the canopy assembly, the canopy accessory cover, the inlet accessory cover, the duct and the blower housing includes a noise reduction material.

13. The vent hood kit of claim 10, wherein an inlet end of the blower housing is attached to the outlet end of the canopy assembly when the blower assembly is in the in-line position.

14. The vent hood kit of claim 10, wherein the blower assembly is configured to be selectively disposed between the in-line and external positions, and wherein a plurality of intake ports are in communication with the blower assembly, wherein the plurality of intake ports are configured to collect steam from a corresponding plurality of spaces distal from the canopy assembly and direct the steam to the exhaust duct adapter, wherein the plurality of intake ports are engaged with a primary branch adapter that receives ductwork from the corresponding plurality of spaces and directs the steam from the ductwork to the blower assembly.

15. The vent hood kit of claim 10, wherein the blower housing includes a plurality of housing walls defining an interior volume, wherein the blower assembly is disposed within the interior volume and coupled to at least one of the plurality of housing walls.

16. The vent hood kit of claim 10, wherein a control is configured to operate the blower assembly when the blower assembly is in either of the in-line and external positions.

17. A vent hood kit comprising:

a blower housing having a plurality of walls defining an inner volume, a blower assembly disposed within the inner volume, and an inlet aperture defined within one of the plurality of walls;

a canopy assembly having an intake end and an outlet end, wherein the outlet end selectively engages the inlet aperture when the blower housing is in one of an in-line position defined by the blower housing being directly connected to the canopy assembly, and an external position defined by the blower housing being distal from the canopy assembly, wherein the blower assembly is in communication with the intake end when the blower housing is in either of the in-line position and the external position, wherein the blower housing includes an integral electrical module that is in selective communication with the canopy assembly and the blower assembly when the blower housing is in either of the in-line and external positions; and at least one accessory cover that is configured to engage at least one of the inlet aperture of the blower housing and the outlet end of the canopy assembly when the blower housing is disposed in the external position, wherein the in-line position is free of the at least one accessory cover.

18. The vent hood kit of claim 17, wherein the at least one accessory cover includes an inlet accessory cover configured to engage the inlet aperture of the blower housing, and a canopy accessory cover configured to engage the outlet end of the canopy assembly.

19. The vent hood kit of claim 17, where the outlet end of the canopy assembly is attached to the blower housing at the inlet aperture when the blower housing is disposed in the in-line position.

20. The vent hood kit of claim 17, wherein the blower housing is configured to be selectively and alternatively disposed between the in-line and external positions.

* * * * *